US007767037B2

(12) United States Patent
Kimura et al.

(10) Patent No.: US 7,767,037 B2
(45) Date of Patent: Aug. 3, 2010

(54) HIGH STRENGTH STAINLESS STEEL PIPE FOR USE IN OIL WELL HAVING SUPERIOR CORROSION RESISTANCE AND MANUFACTURING METHOD THEREOF

(75) Inventors: Mitsuo Kimura, Chiyoda-ku (JP); Takanori Tamari, Chiyoda-ku (JP); Yoshio Yamazaki, Chiyoda-ku (JP); Ryosuke Mochizuki, Chiyoda-ku (JP)

(73) Assignee: JFE Steel Corporation (JP)

( * ) Notice: Subject to any disclaimer, the term of this patent is extended or adjusted under 35 U.S.C. 154(b) by 30 days.

(21) Appl. No.: 10/568,154

(22) PCT Filed: Aug. 11, 2004

(86) PCT No.: PCT/JP2004/011809

§ 371 (c)(1),
(2), (4) Date: Feb. 13, 2006

(87) PCT Pub. No.: WO2005/017222

PCT Pub. Date: Feb. 24, 2005

(65) Prior Publication Data

US 2006/0243354 A1 Nov. 2, 2006

(30) Foreign Application Priority Data

| | | |
|---|---|---|
| Aug. 19, 2003 | (JP) | 2003-295163 |
| Jan. 23, 2004 | (JP) | 2004-016076 |
| Mar. 12, 2004 | (JP) | 2004-071640 |
| Apr. 30, 2004 | (JP) | 2004-135974 |
| Jul. 20, 2004 | (JP) | 2004-210904 |

(51) Int. Cl.

| | |
|---|---|
| ***C22C 38/22*** | (2006.01) |
| ***C22C 38/24*** | (2006.01) |
| ***C22C 38/00*** | (2006.01) |
| ***C22C 38/18*** | (2006.01) |

(52) U.S. Cl. ..... 148/325; 420/61; 420/69; 420/70; 148/909

(58) Field of Classification Search ..... 148/325, 148/909; 420/61, 69, 70
See application file for complete search history.

(56) References Cited

U.S. PATENT DOCUMENTS

| | | | | |
|---|---|---|---|---|
| 6,379,821 | B2 * | 4/2002 | Kushida et al. | 428/685 |
| 2003/0127162 | A1 * | 7/2003 | Kidani et al. | 148/592 |

FOREIGN PATENT DOCUMENTS

EP 1 179 380 A1 2/2002

(Continued)

OTHER PUBLICATIONS

Joseph R. Davis, ASM Handbook-Wrought Stainless Steels, 1990, ASM International, 10th Edition, vol. 1, 852-853.*

*Primary Examiner*—Roy King
*Assistant Examiner*—Caitlin Fogarty
(74) *Attorney, Agent, or Firm*—DLA Piper LLP (US)

(57) ABSTRACT

A stainless steel pipe for use in oil wells which has a high strength having a YS of 654 MPa or more and superior corrosion resistance even in a severe corrosive environment in which $CO_2$ and are present and the temperature is high, such as up to 230° C. The pipe contains on a mass percent basis: 0.005% to 0.05% of C; 0.05% to 0.5% of Si; 0.2% to 1.8% of Mn; 0.03% or less of P; 0.005% or less of S; 15.5% to 18% of Cr; 1.5% to 5% of Ni; 1% to 3.5% of Mo; 0.02% to 0.2% of V; 0.01% to 0.15% of N; 0.006% or less of 0; and the balance being Fe and unavoidable impurities, in which Cr+0.65Ni+0.6Mo+0.55Cu−20C≧19.5 and Cr+Mo+0.3Si−43.5C−0.4Mn−Ni−0.3Cu−9N≧11.5 are satisfied (where Cr, Ni, Mo, Cu, C, Si, Mn, and N represent the respective contents on a mass percent basis). In addition, quenching treatment and tempering treatment are preferably performed, so that the pipe preferably has a texture containing a martensite phase as a primary phase and 10 to 60 percent by volume of a ferrite phase, or further containing 30 percent by volume or less of an austenite phase. Furthermore, at least one of Al, Cu, Nb, Ti, Zr, W, B, and Ca may also be contained.

13 Claims, 2 Drawing Sheets

FOREIGN PATENT DOCUMENTS

| | | | |
|---|---|---|---|
| EP | 1 288 316 | A1 | 3/2003 |
| EP | 1 514 950 | A1 | 3/2005 |
| JP | 03 075336 | A | 3/1991 |
| JP | 3-75337 | A | 3/1991 |
| JP | 8-120345 | A | 5/1996 |
| JP | 8-246107 | A | 9/1996 |
| JP | 9-268349 | A | 10/1997 |
| JP | 10-1755 | A | 1/1998 |
| JP | 28-14528 | B2 | 8/1998 |
| JP | 2001-179485 | A | 7/2001 |
| JP | 2001-279392 | A | 10/2001 |
| JP | 32-51648 | B2 | 11/2001 |
| JP | 2002-4009 | A | 1/2002 |
| JP | 2002-129278 | A | 5/2002 |

* cited by examiner

HIGH STRENGTH STAINLESS STEEL PIPE FOR USE IN OIL WELL HAVING SUPERIOR CORROSION RESISTANCE AND MANUFACTURING METHOD THEREOF

TECHNICAL FIELD

This invention relates to steel pipes for use in crude oil wells or natural gas wells. In particular, the invention relates to a high strength stainless steel having superior corrosion resistance, which is suitably used in an oil well and gas well in a very severe corrosion environment containing carbon dioxide ($CO_2$), chloride ions ($Cl^-$), and the like. The "high strength stainless steel pipe" indicates a stainless steel pipe having a yield strength of 654 MPa (95 ksi) or more.

BACKGROUND

In recent years, in response to steep rise in crude oil price and to depletion of petroleum oil resources anticipated in the near future, deeper oil fields, which have not be taken into consideration in the past, very corrosive sour gas fields, the development of which was abandoned once in the past, and the like have been aggressively developed on a worldwide basis. The oil fields and gas fields as described above are generally located in very deep places, and in addition, these oil and gas fields are in a very severe corrosive environment in which the temperature is high and $CO_2$, $Cl^-$, and the like are present. Hence, as an oil-well steel pipe used for mining oil and gas fields as described above, a steel pipe having high strength and also having superior corrosion resistance is required.

Heretofore, in oil wells and gas wells in an environment containing $CO_2$, $Cl^-$, and the like, 13% Cr martensite stainless steel pipes, which have superior $CO_2$ corrosion resistance, have been generally used as an oil-well steel pipe. However, there has been a problem in that a general martensite stainless steel cannot withstand the use in an environment in which a large amount of $Cl^-$ is present and the temperature is high, such as more than 100° C. Hence, in a well in which steel pipes and the like are required to have corrosion resistance, a dual phase stainless steel pipe has been used. However, since the dual phase stainless steel pipe contains a large amount of alloy elements, hot workability thereof is not superior, and hence a specific hot working can only be used for forming the dual phase stainless steel pipe, thereby causing the increase in cost. In addition, when the yield strength of a conventional 13% Cr martensite stainless steel pipe is more than 654 MPa, the toughness thereof is seriously degraded, and hence there has been a problem in that the 13% Cr martensite stainless steel pipe may not be used.

In addition, in recent years, development of oil wells in cold regions has been increasingly carried out. Hence, besides high strength, superior low-temperature toughness has also been required for the steel pipe in many cases.

According to the situations described above, a high strength 13% Cr martensite stainless steel pipe for use in oil wells has been strongly desired, which is primarily formed of inexpensive 13% Cr martensite stainless steel having excellent hot workability and which has a high yield strength of more than 654 MPa (95 ksi), superior $CO_2$ corrosion resistance, and a high toughness.

In response to the requirements described above, for example, in Japanese Unexamined Applications 8-120345, 9-268349 and 10-1755 and Japanese Patents 28-14528 and 32-51648, improved martensite stainless steel or a steel pipe thereof have been proposed which are obtained by improving the corrosion resistance of 13% Cr martensite stainless steel or a steel pipe thereof.

A technique disclosed in Japanese Unexamined Application 8-120345 is a method for manufacturing a martensite stainless steel seamless pipe having superior corrosion resistance. According to the method described above, after a 13% Cr stainless-steel raw material having a composition in which the content of C is controlled in the range of 0.005% to 0.05%, 2.4% to 6% of Ni and 0.2% to 4% of Cu are collectively added, 0.5% to 3% of Mo is further added, and a Nieq is adjusted to 10.5 or more is processed by hot working, cooling at a rate faster than that of air cooling is performed. Heating may further be performed to a temperature in the range of (the $Ac_3$ transformation point+10° C.) to (the $Ac_3$ transformation point+200° C.) or may further be performed to a temperature in the range of the Ac, transformation point to the $Ac_3$ transformation point, followed by cooling to room temperature at a cooling rate faster than that of air cooling, so that tempering is performed. According to the technique described in Japanese Unexamined Application 8-120345, a martensite stainless steel seamless pipe can be manufactured which simultaneously has a high strength equivalent to or more than that of API-C95 grade, corrosion resistance in an environment at 180° C. or more containing $CO_2$, and the SCC resistance.

A technique disclosed in Japanese Unexamined Application 9-268349 is a method for manufacturing a martensite stainless steel having superior resistance to sulfide stress cracking. According to the method described above, after 13% Cr martensite stainless steel having a composition in which 0.005% to 0.05% of C and 0.005% to 0.1% of N are contained, and in which Ni, Cu, and Mo are controlled in the ranges of 3.0% to 6.0%, 0.5% to 3% and 0.5% to 3%, respectively, is processed by hot working, followed by spontaneous cooling to room temperature, heating is performed to a temperature in the range of (the $Ac_1$ point+10° C.) to (the $Ac_1$ point+40° C.), and the stainless steel is held for 30 to 60 minutes at that temperature and is then cooled to a temperature to the Ms point or less. Subsequently, tempering is performed at a temperature of the $Ac_1$ point or less, so that a texture is formed in which tempered martensite and 20 percent by volume or more of a $\gamma$ phase are both present. A tempered martensite texture containing 20 percent by volume or more of a $\gamma$ phase is formed, the resistance to sulfide stress cracking is significantly improved.

According to a technique described in Japanese Unexamined Application 10-1755, martensite stainless steel has a composition containing 10% to 15% of Cr in which the content of C is controlled in the range of 0.005% to 0.05%, 4.0% or more of Ni and 0.5% to 3% of Cu are collectively added, 1.0% to 3.0% of Mo is further added, and in addition, the Nieq is controlled to −10 or more. By performing tempering, a texture is formed containing a tempered martensite phase, a martensite phase, and a retained austenite phase so that the total fraction of the tempered martensite phase and the martensite phase is set to 60% to 90%, thereby obtaining martensite stainless steel having superior corrosion resistance and resistance to sulfide stress cracking. The corrosion resistance and resistance to sulfide stress cracking in a wet carbon dioxide gas environment and in a wet hydrogen sulfide environment are improved.

A technique described in Japanese Patent 28-14528 relates to a martensite stainless steel material for use in oil wells, having superior resistance to sulfide stress cracking, the stainless steel material having a steel composition in which more than 15% to 19% or Cr is contained, 0.05% or less of C, 0.1% or less of N, and 3.5% to 8.0% of Ni are contained, and 0.1% to 4.0% of Mo is further contained, and in which 30Cr+36Mo+14Si−28Ni≦455 (%) and 21Cr+25Mo+17Si+35Ni≦731 (%) are simultaneously satisfied. A steel material having superior corrosion resistance in a severe oil well environment in which chloride ions, a carbon dioxide gas, and a small amount of a hydrogen sulfide gas are present.

A technique described in Japanese Patent 32-51648 relates to a precipitation hardened martensite stainless steel having superior strength and toughness, the stainless steel having a steel composition in which 10.0% to 17% or Cr is contained, 0.08% or less of C, 0.015% or less of N, 6.0% to 10.0% of Ni, and 0.5% to 2.0% of Cu are contained, and 0.5% to 3.0% of Mo is further contained, and having a texture in which, owing to a cold working of 35% or more and annealing, the average crystal particle diameter is set to 25 μm or less and the number of precipitates, which are precipitated in a matrix and which have a particle diameter of $5\times10^{-2}$ μm or more, is reduced to $6\times10^{6}/mm^{2}$ or less. Since a texture is formed containing fine crystal particles and having a small amount of precipitates, precipitation hardened martensite stainless steel, which has a high strength and causes no decrease in toughness, can be provided.

However, there has been a problem in that improved 13% Cr martensite stainless steel pipes manufactured by the techniques discussed above cannot stably exhibit desired corrosion resistance in a severe corrosive environment in which $CO_2$, $Cl^-$, and the like are present and the temperature is high, such as more than 180° C.

SUMMARY

Aspects of this invention provide a high strength stainless steel pipe for use in oil wells and the manufacturing method thereof, the high strength stainless steel pipe being inexpensive, and having superior hot workability, a high yield strength of more than 654 MPa, and superior corrosion resistance such as superior $CO_2$ corrosion resistance even in a severe corrosive environment in which $CO_2$, $Cl^-$ and the like are present and the temperature is high, such as up to 230° C.

(1) There is provided a high strength stainless steel pipe for use in oil wells, which has superior corrosion resistance, comprising on a mass percent basis: about 0.005% to about 0.05% of C; about 0.05% to about 0.5% of Si; about 0.2% to about 1.8% of Mn; about 0.03% or less of P; about 0.005% or less of S; about 15.5% to about 18% of Cr; about 1.5% to about 5% of Ni; about 1% to about 3.5% of Mo; about 0.02% to about 0.2% of V; about 0.01% to about 0.15% of N; about 0.006% or less of O; and the balance being Fe and unavoidable impurities, in which the following equations (1) and (2) are satisfied:

$$Cr+0.65Ni+0.6Mo+0.55Cu-20C\geqq19.5 \quad (1)$$

$$Cr+Mo+0.3Si-43.5C-0.4Mn—Ni-0.3Cu-9N\geqq11.5 \quad (2)$$

(where Cr, Ni, Mo, Cu, C, Si, Mn, and N represent the respective contents on a mass percent basis).

(2) In addition to the above composition, the high strength stainless steel pipe for use in oil wells may further comprise about 0.002% to about 0.05% of Al on a mass percent basis.

(3) The content of C may be in the range of about 0.03% to about 0.05% on a mass percent basis.

(4) The content of Cr may be in the range of about 16.6% to less than about 18% on a mass percent basis.

(5) The content of Mo may be in the range of about 2% to about 3.5% on a mass percent basis.

(6) The high strength stainless steel pipe may further comprise about 3.5% or less of Cu on a mass percent basis.

(7) The content of Cu may be in the range of about 0.5% to about 1.14% on a mass percent basis.

(8) The high strength stainless steel pipe may further comprise at least one element selected from the group consisting of about 0.2% or less of Nb, about 0.3% or less of Ti, about 0.2% or less of Zr, about 3% or less of W, and about 0.01% or less of B on a mass percent basis.

(9) In addition to the above composition, the high strength stainless steel pipe may further comprise about 0.01% or less of Ca on a mass percent basis.

(10) The high strength stainless steel pipe may have a texture containing a martensite phase as a primary phase and a ferrite phase at a volume fraction of about 10% to about 60%.

(11) The ferrite phase may have a volume fraction of about 15% to about 50%.

(12) The texture may further contain an austenite phase at a volume fraction of about 30% or less.

(13) There is provided a method for manufacturing a high strength stainless steel pipe for use in oil wells having superior corrosion resistance, comprising the steps of: preparing a steel pipe raw material which contains on a mass percent basis, about 0.005% to about 0.05% of C; about 0.05% to about 0.5% of Si; about 0.2% to about 1.8% of Mn; about 0.03% or less of P; about 0.005% or less of S; about 15.5% to about 18% of Cr; about 1.5% to about 5% of Ni; about 1% to about 3.5% of Mo; about 0.02% to about 0.2% of V; about 0.01% to about 0.15% of N; about 0.006% or less of O; and the balance being Fe and unavoidable impurities, and which satisfies the following equations (1) and (2); making a steel pipe having a predetermined dimension from the steel pipe raw material; and performing quenching-tempering treatment for the steel pile, in which the steel pipe is reheated to a temperature of about 850° C. or more, is then cooled to about 100° C. or less at a cooling rate faster than that of air cooling, and is again heated to a temperature of about 700° C. or less, the equations being:

$$Cr+0.65Ni+0.6Mo+0.55Cu-20C\geqq19.5 \quad (1)$$

$$Cr+Mo+0.3Si-43.5C-0.4Mn—Ni-0.3Cu-9N\geqq11.5 \quad (2)$$

(where Cr, Ni, Mo, Cu, C, Si, Mn, and N represent the respective contents on a mass percent basis).

(14) Pipe making may be performed by hot working while the steel pipe raw material is heated, and cooling may then be performed to room temperature at a cooling rate faster than that of air cooling to form the seamless steel pipe having a predetermined dimension, followed by the above quenching-tempering treatment.

(15) Instead of the above quenching-tempering treatment, tempering treatment may be performed by heating the steel pipe to a temperature of above 700° C. or less.

(16) In addition to the above composition in the method, the steel pipe raw material may further contain about 0.002% to about 0.05% of Al on a mass percent basis.

(17) In the method, the content of C may be in the range of about 0.03% to about 0.05%.

(18) In the method, the content of Cr may be in the range of about 16.6% to less than about 18%.

(19) In the method, the content of Mo may be in the range of about 2% to about 3.5% on a mass percent basis.

(20) In the method, in addition to the above composition, the steel pipe raw material may further contain about 3.5% or less of Cu on a mass percent basis.

(21) In the method, the content of Cu may be in the range of about 0.5% to about 1.14% on a mass percent basis.

(22) In the method, in addition to the above composition, the steel pipe raw material may further contain at least one of about 0.2% or less of Nb, about 0.3% or less of Ti, about 0.2% or less of Zr, about 3% or less of W, and about 0.01% or less of B on a mass percent basis.

(23) In the method, in addition to the above composition, the steel pipe raw material may further contain about 0.01% or less of Ca on a mass percent basis.

DETAILED DESCRIPTION

In manufacturing a conventional martensite stainless steel seamless pipe, when a martensite single phase is not obtained due to the formation of a ferrite phase, the strength is decreased and hot workability is degraded. Hence, it has been generally believed that manufacturing of the steel pipe cannot be easily performed. Accordingly, as disclosed in Japanese Unexamined Application 8-246107, generally in a 13% Cr stainless steel seamless pipe for use in oil wells, for manufacturing, the composition thereof has been controlled so that the formation of ferrite is suppressed to obtain a texture formed of a martensite single phase.

We found that, when the steel composition is controlled to satisfy the following equation (2), the hot workability is significantly improved, and generation of cracks in hot working can be prevented:

$$Cr+Mo+0.3Si-43.5C-0.4Mn—Ni-0.3Cu-9N \geqq 11.5 \quad (2)$$

(where Cr, Ni, Mo, Cu, C, Si, Mn, and N represent respective contents on a mass percent basis).

Figure 1:
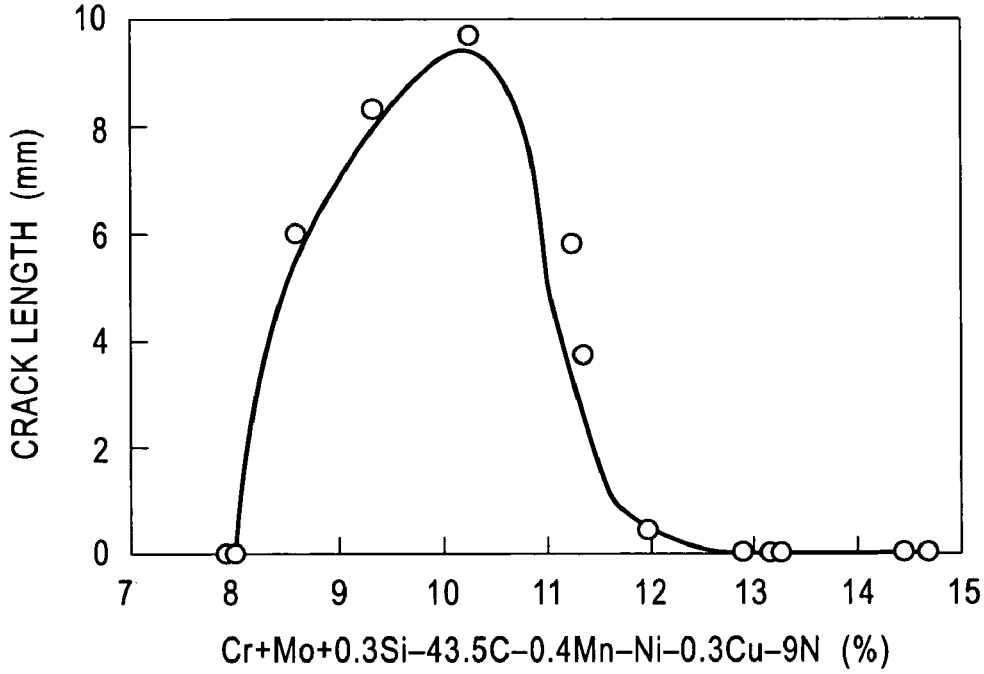
FIG. 1 is a graph showing the relationship between the crack length and the value of the left-hand side of equation (2).

FIG. 1 shows the relationship between the value of the left-hand side of the equation (2) and the length of crack generated in an end surface of a 13% Cr stainless steel seamless pipe in hot working (that is, in pipe making of a seamless steel pipe). As can be seen from FIG. 1, it is understood that, when the value of the left-hand side of the equation (2) is 8.0 or less, or the left-hand side of the equation (2) is 11.5 or more and is preferably 12.0 or more, the generation of cracks can be prevented. A value of the left-hand side of the equation (2) of 8.0 or less represents a region in which ferrite is not formed at all, and this region corresponds to a region defined by the conventional concept of improvement in hot workability in which the formation of a ferrite phase is not allowed. In addition, as the value of the left-hand side of the equation (2) is increased, the amount of ferrite thus formed is increased, and in the region in which the value of the left-hand side is 11.5 or more, a relatively large amount of ferrite is formed. That is, we found that when the concept is employed that is totally different from the conventional one in the past, that is, when the composition is adjusted to have a value of the left-hand side of 11.5 or more so that a texture containing a relatively large amount of ferrite is used in pipe making, the hot workability can be significantly improved.

Figure 2:
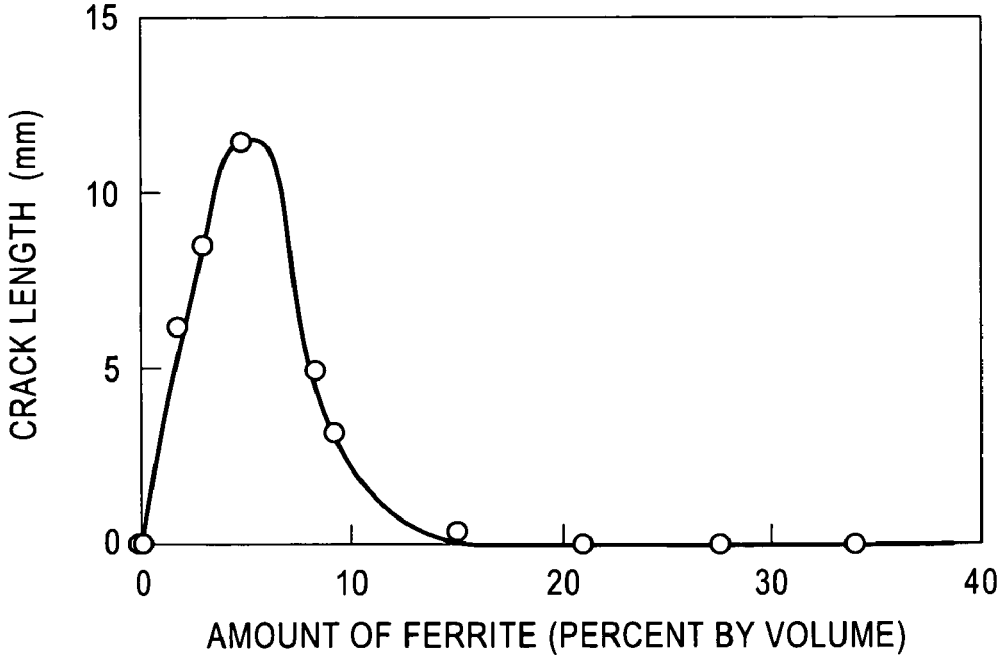
FIG. 2 is a graph showing the relationship between the crack length and the amount of ferrite.

FIG. 2 shows the relationship between the amount of ferrite and the length of crack generated in the end surface of a 13% Cr stainless steel seamless pipe in hot working, the relationship being obtained based on the data described above. As can be seen from FIG. 2, as is the conventional concept, cracks are not generated when the amount of ferrite is 0 percent by volume. However, as ferrite is formed, cracking starts to occur. When the amount of ferrite is further increased to 10 percent by volume or more and preferably 15 percent by volume or more, generation of cracks can be prevented, and this phenomenon is totally different from that based on the conventional concept. That is, when the components are adjusted to satisfy the equation (2), and a ferrite-martensite dual phase is formed in which an appropriate amount of a ferrite phase is formed, the hot workability is improved, and the generation of cracks can be prevented. In addition, it was also found that, when a ferrite-martensite dual phase texture is used, a strength required for oil well pipes can also be ensured.

However, when the components are adjusted to satisfy the equation (2) to form a ferrite-martensite dual phase texture, the corrosion resistance may be degraded in some cases due to the distribution of elements which occurs during heat treatment. When the dual phase texture is formed, since elements such as C, Ni, and Cu forming an austenite phase are diffused to a martensite phase, and elements such as Cr and Mo forming a ferrite phase are diffused to a ferrite phase, as a result, variation between the phases occurs in the final product obtained after heat treatment. In the martensite phase, since the amount of Cr effective for corrosion resistance is decreased, and the amount of C degrading corrosion resistance is increased, as a result, the corrosion resistance may be degraded in some cases as compared to that of a uniform texture.

We also found that, by adjusting components to satisfy the following equation (1), even when a ferrite-austenite dual phase texture is formed, sufficient corrosion resistance can be ensured:

$$Cr+0.65Ni+0.6Mo+0.55Cu-20C \geqq 19.5 \quad (1)$$

(where Cr, Ni, Mo, Cu, and C represent the respective contents on a mass percent basis).

Figure 3:
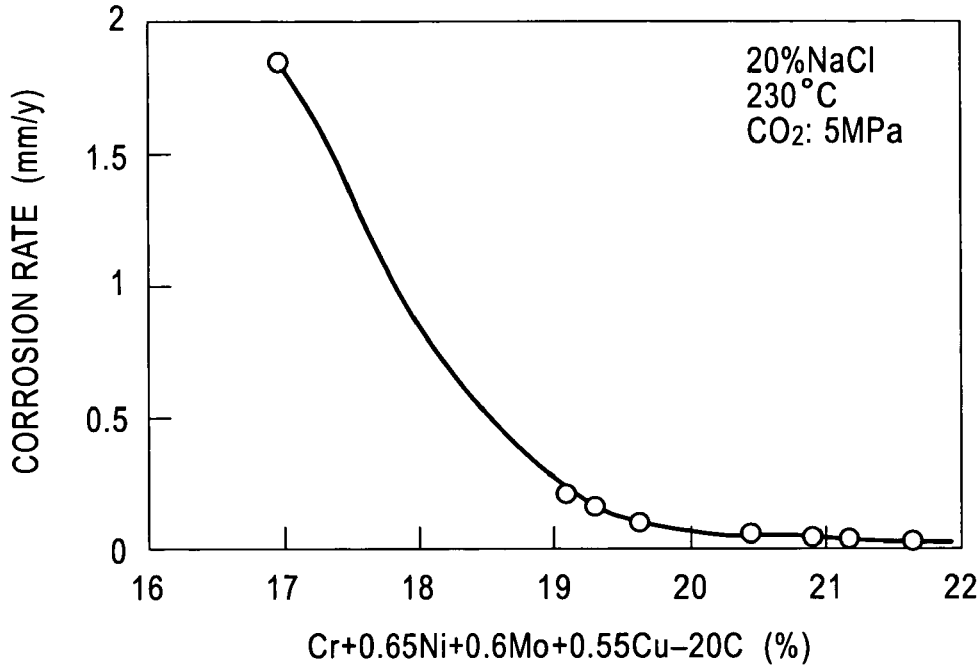
FIG. 3 is a graph showing the relationship between the corrosion rate and the value of the left-hand side of equation (1).

FIG. 3 shows the relationship between the value of the left-hand side of the equation (1), even when a ferrite-austenite dual phase texture is formed, in a high temperature environment at 230° C. containing $CO_2$ and $Cl^-$, sufficient corrosion resistance can be ensured.

As apparent from equation (1), the content of Cr is advantageously increased to improve the corrosion resistance. However, Cr promotes the formation of ferrite. Hence, in order to suppress the formation of ferrite, Ni in an amount corresponding to the content of Cr was necessary to be added in the past. However, when the content of Ni is increased to correspond to the content of Cr, an austenite phase is stabilized and, as a result, a problem may arise in that the strength required for oil well pipes cannot be ensured.

We found that, when the content of Cr is increased while a ferrite-austenite dual phase texture containing an appropriate amount of a ferrite phase is maintained, a remaining amount of an austenite phase can be reduced and a sufficient strength as an oil well pipe can be ensured.

Figure 4:
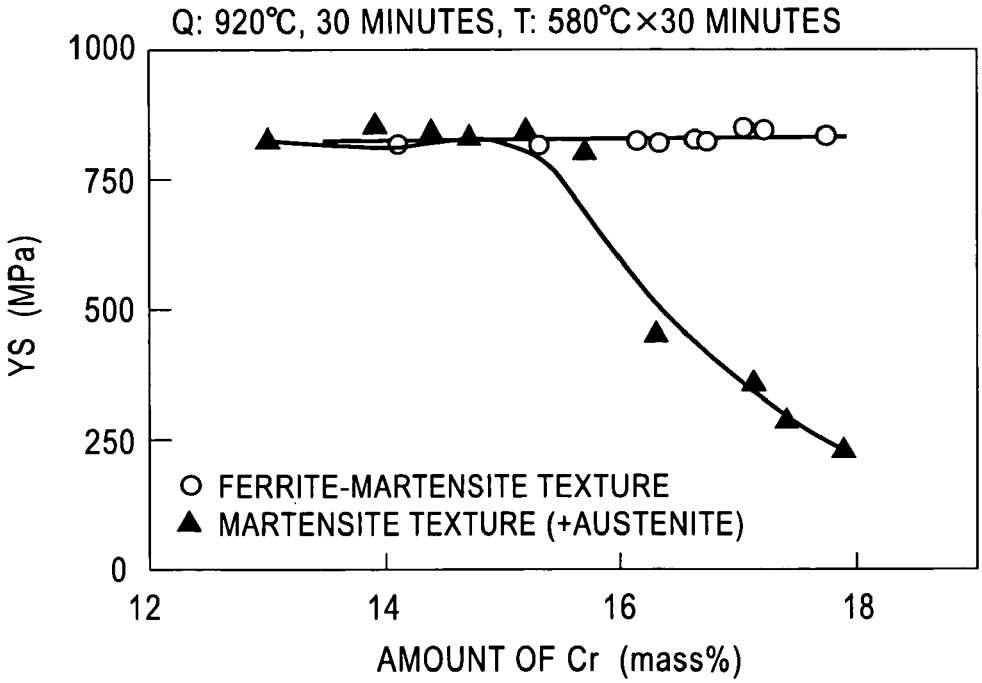
FIG. 4 is a graph showing the influence of a texture on the relationship between a yield strength YS and the amount of Cr.

FIG. 4 shows the relationship between the content of Cr and the yield strength YS of a 13% Cr stainless steel seamless pipe containing a ferrite-austenite dual phase texture processed by heat treatment. In FIG. 4, the relationship between the content of Cr and the yield strength YS of a martensite single phase texture or a martensite-austenite dual phase texture processed by heat treatment is also shown. From FIG. 4, it was first found that when the ferrite-austenite dual phase texture containing an appropriate amount of a ferrite phase is maintained, and the content of Cr is increased, a sufficient strength as an oil well pipe can be ensured. On the other hand, when the texture is a martensite single phase or a martensite-austenite dual phase texture, as the amount of Cr is increased, the YS is decreased.

The reason the composition of the high strength stainless steel pipe for use in oil wells is in a specific range will be described below. Hereinafter, the content on a mass percent basis will be simply represented by %.

C: About 0.005% or More to About 0.05% or Less

C is an important element relating to the strength of martensite stainless steel and is required to have a content of about 0.005% or more. However, when the content is more than about 0.05%, the degree of sensitization in tempering caused by contained Ni is increased. The content of C is set in the range of about 0.005% to about 0.05% to prevent this sensitization. In addition, in view of corrosion resistance, a smaller amount of C is more preferable. However, to ensure the strength, a large amount of C is preferable. In consideration of the balance therebetween, the content of C is preferably in the range of about 0.03% to about 0.05%.

Si: About 0.05% or More to About 0.5% to Less

Si is an element functioning as a deoxidizing agent, and about 0.05% or more of Si is contained. However, when the content is more than about 0.5%, $CO_2$ corrosion resistance is degraded, and in addition, the hot workability is also degraded. Hence, the content of Si is set in the range of about 0.05% to about 0.5%. In addition, the content is preferably in the range of about 0.1% to about 0.3%.

Mn: About 0.2% or More to About 1.8% or Less

Mn is an element increasing the strength, and to ensure a desired strength, the content of Mn is about 0.2% or more. However, when the content is more than about 1.8%, the toughness is adversely influenced. Hence, the content of Mn is set in the range of about 0.2% to about 1.8%. In addition, the content is preferably in the range of about 0.2% to about 1.0% and more preferably in the range of about 0.2% to about 0.8%.

P: About 0.03% or Less

P is an element degrading the $CO_2$ corrosion resistance, resistance to $CO_2$ stress corrosion cracking, pitting resistance, and resistance to sulfide stress cracking, and hence the content of P is preferably decreased as small as possible. However, when the content is excessively decreased, the manufacturing cost is inevitably increased. As the content which can be obtained at an inexpensive cost from an industrial point of view and which may not degrade the $CO_2$ corrosion resistance, resistance to $CO_2$ stress corrosion cracking, pitting resistance, and resistance to sulfide stress cracking, the content of P is set to about 0.03% or less. In addition, the content is preferably about 0.02% or less.

S: About 0.005% or Less

S is an element seriously degrading the hot workability in a pipe manufacturing process, and hence the content thereof is preferably decreased as small as possible. However, when the content is decreased to about 0.005% or less, since pipe manufacturing can be performed by using a common process, the content of S is set to about 0.005% or less. In addition, the content is preferably about 0.002% or less.

Cr: About 15.5% or More to About 18% or Less

Cr is an element improving the corrosion resistance by forming a protective film and, in particular, is an element improving the $CO_2$ corrosion resistance and the resistance to $CO_2$ stress corrosion cracking. To improve the corrosion resistance at a high temperature, in particular, the content is about 15.5% or more. On the other hand, when the content is more than about 18%, the hot workability is degraded and, in addition, the strength decreases. Hence, the content of Cr is set in the range of about 15.5% to about 18%. In addition, the content is preferably in the range of about 16.5% to about 18% and more preferably in the range of about 16.6% to less than about 18%.

Ni: About 1.5% or More to About 5% or Less

Ni functions to make the protective film stronger and improve the $CO_2$ corrosion resistance, resistance to $CO_2$ stress corrosion cracking, pitting resistance, and resistance to sulfide stress cracking. The above functions can be obtained when the content is about 1.5% or more. However, when the content is more than about 5%, the stability of the martensite texture is degraded, and the strength is decreased. Hence, the content of Ni is set in the range of about 1.5% to about 5%. In addition, the content is preferably in the range of about 2.5% to about 4.5%.

Mo: About 1% or More to About 3.5% or Less

Mo is an element increasing the resistance to pitting corrosion caused by $Cl^-$, and the content of Mo is about 1% or more. When the content is less than about 1%, the corrosion resistance is not sufficient in a severe corrosive environment at a high temperature. On the other hand, when the content is more than about 3.5%, in addition to the decrease in strength, the cost is increased. Hence, the content of Mo is set in the range of about 1% to about 3.5%. In addition, the content is preferably in the range of more than about 2% to about 3.5%.

V: About 0.02% or More to About 0.2% or Less

V has effects to increase the strength and improve the resistance to stress corrosion cracking. The effects as described above become significant when the content is about 0.02% or more. However, when the content is more than about 0.2%, the toughness is degraded. Hence, the content of V is set in the range of about 0.02% to about 0.2%. In addition, the content is preferably in the range of about 0.02% to about 0.08%.

N: About 0.01% or More to About 0.15% or Less

N is an element improving the pitting resistance, and the content thereof is set to about 0.01% or more. However, when the content is more than about 0.15%, various nitrides are formed, and as a result, the toughness is degraded. Hence, the content of N is set in the range of about 0.01% to about 0.15%. In addition, the content is preferably in the range of about 0.02% to about 0.08%.

O: About 0.006% or Less

O is present in the form of oxides in steel and has adverse influences on various properties. Hence, the content of O is preferably decreased as small as possible for improving the properties. In particular, when the content of O is more than about 0.006%, the hot workability, resistance to $CO_2$ stress corrosion cracking, pitting resistance, resistance to sulfide stress cracking, and toughness are seriously degraded. Hence, the content of O is set to about 0.006% or less.

In addition to the above basic composition, about 0.002% to about 0.05% of Al may also be contained. Al is an element having a strong deoxidizing effect, and to obtain the above effect, the content is preferably about 0.002% or more. However, when the content is more than about 0.05%, the toughness is adversely influenced. Hence, when Al is contained, the content thereof is preferably set in the range of about 0.002% to about 0.05%. In addition, the content is more preferably about 0.03% or less. When Al is not contained, Al in a content of approximately less than about 0.002% is allowable as an unavoidable impurity. When the content of Al is controlled to approximately less than about 0.002%, an advantage in that low temperature toughness is significantly increased can be obtained.

In addition to the above components described above, about 3.5% or less of Cu may be further contained. Cu is an element which makes the protective film strong, prevents hydrogen from penetrating steel, and improves the resistance to sulfide stress cracking, and when the content is about 0.5% or more, the above effects become significant. However, when the content is more than about 3.5%, grain boundary precipitation of CuS occurs, and as a result, the hot workability is degraded. Hence, the content of Cu is preferably set to about 3.5% or less. In addition, the content is more preferably in the range of about 0.8% to about 2.5% and even more preferably in the range of about 0.5% to about 1.14%.

In addition to the components described above, at least one element selected from about 0.2% or less of Nb, about 0.3% or less of Ti, about 0.2% or less of Zr, about 3% or less of W, and about 0.01% or less of B may be further contained.

Nb, Ti, Zr, W, and B are elements each increasing the strength and may be selectively contained whenever necessary. In addition, Ti, Zr, W, and B are also elements improving the resistance to stress corrosion cracking. The effects described above become significant, when about 0.03% or more of Nb, about 0.03% or more of Ti, about 0.03% or more of Zr, about 0.2% or more of W, or about 0.0005% or more of B is contained. On the other hand, when more than about 0.2% of Nb, more than about 0.3% of Ti, more than about 0.2% of Zr, more than about 3% of W, or more than about 0.01% of B is contained, the toughness is degraded. Hence, the contents of Nb, Ti, Zr, W, and B are preferably set to about 0.2% or less, about 0.3% or less, about 0.2% or less, about 3% or less, and about 0.01% or less, respectively.

In addition to the above components described above, about 0.01% or less of Ca may also be contained. Ca fixes S by forming CaS and serves to spheroidize sulfide inclusions. Hence, lattice strains of matrix in the vicinity of the inclusions are decreased, so that an effect of decreasing hydrogen trapping ability of the inclusions can be obtained. The effect described above becomes significant when the content is about 0.0005% or more. However, when the content is more than about 0.01%, the amount of CaO is increased, and as a result, the $CO_2$ corrosion resistance and the pitting resistance are degraded. Hence, the content of Ca is preferably set to about 0.01% or less.

While being within the ranges described above, the contents of the above components are adjusted to satisfy the following equations (1) and (2):

$$Cr+0.65Ni+0.6Mo+0.55Cu-20C \geqq 19.5 \quad (1)$$

$$Cr+Mo+0.3Si-43.5C-0.4Mn—Ni-0.3Cu-9N \geqq 11.5 \quad (2).$$

In the above equations, Cr, Ni, Mo, Cu, C, Si, Mn, and N represent the respective contents (percent by mass). In addition, when the left-hand sides of equations (1) and (2) are calculated, the content of an element which is not contained is regarded as 0% for calculation.

When the contents of Cr, Ni, Mo, Cu, and C are adjusted to satisfy equation (1), corrosion resistance in a corrosive environment in which the temperature is high, such as up to 230° C., and $CO_2$ and $Cl^-$ are present can be significantly improved. In addition, in view of improvement in corrosion resistance in a high temperature corrosive environment containing $CO_2$ and $Cl^-$, the value of the left-hand side of equation (1) is preferably set to 20.0 or more.

In addition, when the contents of Cr, Mo, Si, C, Mn, Ni, Cu, and N are adjusted to satisfy equation (2), the hot workability is improved. The contents of P, S, and O are considerably decreased to improve hot workability. However, when the contents of P, S, and O are each only decreased, sufficient and enough hot workability cannot be ensured for making a martensite stainless steel seamless pipe. To ensure sufficient and enough hot workability for making a stainless steel seamless pipe, in addition to a decrease in content of P, S, and O, it is important that the contents of Cr, Mo, Si, C, Mn, Ni, Cu, and N are adjusted to satisfy equation (2). In addition, in view of improvement in hot workability, the value of the left-hand side of equation (2) is preferably set to 12.0 or more.

The balance other than the components described above includes Fe and unavoidable impurities.

In addition to the components described above, the high strength stainless steel pipe for use in oil wells preferably has a texture containing a martensite phase as a primary phase and a ferrite phase at a volume fraction of about 10% to about 60% and preferably of more than about 10% to about 60%.

The steel pipe contains a martensite texture as a primary texture to ensure high strength. The texture preferably contains a martensite phase as a primary phase and a ferrite phase as a second phase at a volume fraction of about 10% to about 60% and preferably of more than about 10% to about 60% to improve the toughness without decreasing the strength. When the ferrite phase is about 10 percent by volume or less, a predetermined object cannot be achieved. On the other hand, when more than about 60 percent by volume of the ferrite phase is contained, the strength is decreased. Hence, the volume fraction of the ferrite phase is set in the range of about 10% to about 60% and is preferably set in the range of more than about 10% to about 60%. In addition, more preferably, the volume fraction is in the range of about 15% to about 50%. As the second phase other than the ferrite phase, when an austenite phase at a volume fraction of about 30% or less is contained, no problems may arise at all.

Next, a method for manufacturing a steel pipe will be described using a seamless steel pipe by way of example.

It is preferable that, first, molten steel having the composition described above is formed into an ingot by a known ingot-forming method using a converter, an electric furnace, a vacuum melting furnace, or the like, followed by formation of steel pipe raw materials such as billets using a known method including a continuous casting method or an ingot making-bloom rolling method. Next, these steel pipe raw materials are heated and processed by hot working for making a pipe using a manufacturing process such as a general Mannesmann-plug mill method or Mannesmann-mandrel mill method, so that a seamless steel pipe having a desired dimension is formed. After the pipe making, the seamless steel pipe is preferably cooled to room temperature at a cooling rate faster than that of air cooling. Alternatively, the seamless steel pipe may be manufactured by hot extrusion using a press method.

When a seamless steel pipe has the above described composition, a texture having a martensite phase as a primary phase can be formed by hot working, followed by cooling to room temperature at a cooling rate faster than that of air cooling. However, it is preferable that, after the pipe making and following the cooling at a cooling rate faster than that of air cooling, quenching treatment be performed in which reheating is performed to a temperature of about 850° C. or more, followed by cooling to about 100° C. or less and preferably to room temperature at a cooling rate faster than that of air cooling. By the above treatment, a fine and tough martensite texture containing an appropriate amount of a ferrite phase can be obtained.

When the quenching temperature is less than about 850° C., sufficient quenching cannot be performed for a martensite portion, and as a result, the strength tends to decrease. Hence, the heating temperature in the quenching treatment is preferably set to about 850° C. or more.

Subsequently, the seamless steel pipe processed by the quenching treatment is preferably processed by tempering treatment in which the steel pipe is heated to a temperature of about 700° C. or less, followed by cooling at a cooling rate faster than that of air cooling. By tempering treatment in which heating is performed to about 700° C. or less and preferably to about 400° C. or more, a texture is obtained which is formed of a tempered martensite phase or is formed of the tempered martensite phase together with small amounts of a ferrite phase and an austenite phase, so that a seamless steel pipe can be obtained having a desired high toughness and desired superior corrosion resistance besides a desired high strength.

Alternatively, the tempering treatment may only be performed without performing the quenching treatment.

Selected aspects of the invention have been described using the seamless steel pipe by way of example. However, those aspects are not limited thereto. By using a steel pipe raw material having the composition within the above described range and in accordance with a common manufacturing process, an electric resistance welded steel pipe and a UOE steel pipe can be manufactured as an oil-well steel pipe.

For steel pipes other than the seamless steel pipe, such as an electric resistance welded steel pipe and a UOE steel pipe, which are obtained in accordance with a common manufacturing process using a steel pipe raw material having the composition within the range described above, the quenching-tempering treatment described above is preferably performed after pipe making. That is, it is preferable that the quenching treatment be performed in which reheating is performed to a temperature of about 850° C. or more, followed by cooling to about 100° C. or less and preferably to room temperature at a cooling rate faster than that of air cooling, and that the tempering treatment be then performed in which heating is performed to about 700° C. or less and preferably to about 400° C. or more, followed by cooling at a cooling rate faster than that of air cooling.

EXAMPLES

Next, selected aspects of the invention will be further described in detail with reference to the examples.

Example 1

After degassing was performed, molten steel having the composition shown in Table 1 was cast into a steel ingot (steel pipe raw material) in an amount of 100 kg, followed by hot working using a model seamless rolling mill for pipe making. After the pipe making, air cooling or water cooling was performed, so that a seamless steel pipe (having an outer diameter of 83.8 mm and a wall thickness of 12.7 mm (3.3 inches and 0.5 inches in wall thickness) was obtained.

The seamless steel pipe thus obtained was examined by visual inspection whether cracks were generated in the inner and the outer surfaces while the steel pipe was placed in a state of air cooling performed after the pipe making, so that the hot workability was evaluated. When a crack having a length of 5 mm or more was present in the front and the rear end surfaces of the pipe, it was determined that a crack was generated, and in the other cases, it was determined that no cracks were generated.

In addition, from the seamless steel pipe thus obtained, a test piece raw material was formed by cutting and was heated to 920° C. for 30 minutes, followed by water cooling (800° C. or more, at an average cooling rate of 10° C./second to 500° C.). Furthermore, tempering treatment at 580° C. for 30 minutes was performed. A test piece for texture observation was obtained from the test piece raw material processed by the above quenching-tempering treatment, followed by corrosion treatment using aqua regia. Subsequently, an image of the texture of the test piece was taken using a scanning electron microscope (at 1,000 magnifications), and by using an image analysis device, the fraction (percent by volume) of a ferrite phase was calculated.

In addition, the fraction of a retained austenite phase was also measured by an x-ray diffraction method. After a test piece for measurement was obtained from the test piece raw material processed by the quenching-tempering treatment, the diffracted x-ray integrated intensity of the (220) plane of $\gamma$ and that of the (211) plane of $\alpha$ were measured using an x-ray diffraction method and were then converted by the following equation. By the way, the fraction of the martensite phase was calculated as a remaining part other than the phases described above.

$$\gamma(\text{volume fraction})=100/\{1+(I\alpha R\gamma/I\gamma R\alpha)\}$$

In the above equation, the symbols are:

$I\alpha$: integrated intensity of $\alpha$, $I\gamma$: integrated intensity of $\gamma$, $R\alpha$: crystallographic theoretical calculation value of $\alpha$, $R\gamma$: crystallographic theoretical calculation value of $\gamma$.

In addition, after an arc-shaped API tensile test piece was formed from the test piece raw material processed by the quenching-tempering treatment, a tensile test was performed, so that the tensile properties (yield strength YS and tensile strength TS) were obtained.

Furthermore, a corrosion test piece having a thickness of 3 mm, a width of 30 mm, and a length of 40 mm was formed by machining from the test piece raw material processed by the quenching-tempering treatment, and a corrosion test was then performed.

In the corrosion test, the corrosion test piece was immersed in an aqueous test solution containing 20% of NaCl (at a solution temperature of 230° C. under 100 atmospheric pressure in a $CO_2$ gas atmosphere) placed in an autoclave and was held for 2 weeks as an immersion period. The weight of the corrosion test piece after the corrosion test was measured, and from the reduction in weight before and after the corrosion test, the corrosion rate was obtained by calculation. In addition, by using the corrosion test piece after the corrosion test, the presence of pitting generated in the surface of the test piece was observed using a loupe having a magnification of 10×. When a pitting hole having a diameter of 0.2 mm or more was formed by pitting, it was determined that pitting occurred, and in the other cases, it was determined that no pitting occurred. The results are shown in Table 2.

TABLE 1

| Steel No. | Chemical components C | Si | Mn | P | S | Cr | Ni | Mo | Al | V | N | O | Cu | Nb, Ti, Zr, W, B | Ca | Value of left-hand side of equation (1)* | Value of left-hand side of equation (2)** | Remarks |
|---|---|---|---|---|---|---|---|---|---|---|---|---|---|---|---|---|---|---|
| A | 0.017 | 0.19 | 0.26 | 0.01 | 0.002 | 16.6 | 3.5 | 1.6 | 0.01 | 0.047 | 0.047 | 0.0031 | 0.98 | — | — | 20.04 | 13.19 | Example |
| B | 0.023 | 0.18 | 0.35 | 0.01 | 0.001 | 17.4 | 3.7 | 2.5 | 0.01 | 0.057 | 0.053 | 0.0023 | — | Nb: 0.068 | — | 20.85 | 14.64 | Example |
| C | 0.019 | 0.21 | 0.30 | 0.01 | 0.001 | 17.0 | 3.6 | 2.4 | 0.01 | 0.059 | 0.057 | 0.0270 | — | Ti: 0.036 | — | 20.40 | 14.40 | Example |
| D | 0.025 | 0.23 | 0.29 | 0.02 | 0.001 | 17.4 | 2.6 | 2.1 | 0.01 | 0.049 | 0.062 | 0.0035 | 0.80 | Zr: 0.025 | — | 20.29 | 14.97 | Example |
| E | 0.026 | 0.20 | 0.38 | 0.02 | 0.002 | 16.8 | 3.8 | 1.9 | 0.01 | 0.038 | 0.044 | 0.0028 | 1.24 | Ti: 0.021, B: 0.001 | — | 20.57 | 12.91 | Example |
| F | 0.023 | 0.21 | 0.36 | 0.02 | 0.001 | 17.8 | 3.6 | 1.8 | 0.01 | 0.051 | 0.039 | 0.0025 | — | — | 0.002 | 20.76 | 14.57 | Example |
| G | 0.018 | 0.23 | 0.31 | 0.02 | 0.001 | 17.5 | 4.0 | 2.4 | 0.01 | 0.046 | 0.050 | 0.0019 | 0.75 | Nb: 0.044 | 0.001 | 21.59 | 14.39 | Example |
| H | 0.033 | 0.25 | 0.27 | 0.01 | 0.001 | 17.2 | 3.9 | 2.0 | 0.02 | 0.055 | 0.063 | 0.0016 | — | W: 0.26 | — | 20.28 | 13.26 | Example |
| I | 0.012 | 0.27 | 0.45 | 0.02 | 0.001 | 16.7 | 2.6 | 1.9 | 0.01 | 0.046 | 0.056 | 0.0028 | — | — | — | 19.29 | 14.88 | Comparative example |
| J | 0.028 | 0.29 | 0.35 | 0.02 | 0.001 | 15.4 | 3.8 | 2.7 | 0.01 | 0.055 | 0.106 | 0.0017 | 1.16 | — | — | 19.57 | 11.73 | Comparative example |
| K | 0.035 | 0.28 | 0.39 | 0.02 | 0.001 | 16.1 | 4.6 | 1.9 | 0.02 | 0.048 | 0.042 | 0.0024 | 0.62 | Ti: 0.025 | — | 19.87 | 11.24 | Comparative example |
| L | 0.023 | 0.24 | 0.35 | 0.01 | 0.002 | 16.3 | 4.6 | 1.5 | 0.02 | 0.063 | 0.059 | 0.0026 | 1.18 | — | — | 20.36 | 11.33 | Comparative example |
| M | 0.026 | 0.29 | 0.36 | 0.02 | 0.001 | 17.1 | 3.3 | 0.4 | 0.01 | 0.065 | 0.058 | 0.0034 | — | Nb: 0.061 | — | 18.97 | 12.49 | Comparative example |
| N | 0.012 | 0.25 | 0.32 | 0.02 | 0.001 | 17.3 | 2.9 | 2.6 | 0.02 | 0.056 | 0.045 | 0.0018 | — | — | — | 20.75 | 15.59 | Example |
| O | 0.027 | 0.26 | 0.30 | 0.01 | 0.001 | 17.2 | 1.0 | 2.9 | 0.02 | 0.060 | 0.051 | 0.0030 | — | — | — | 19.59 | 17.42 | Comparative example |
| P | 0.019 | 0.17 | 0.28 | 0.02 | 0.001 | 17.7 | 2.8 | 2.7 | 0.01 | 0.061 | 0.031 | 0.0038 | 0.22 | Nb: 0.077 | — | 20.88 | 16.37 | Example |
| Q | 0.014 | 0.28 | 0.25 | 0.02 | 0.001 | 17.8 | 2.5 | 3.3 | 0.01 | 0.052 | 0.024 | 0.0025 | — | Ti: 0.064 | — | 21.13 | 17.76 | Example |
| R | 0.009 | 0.25 | 0.31 | 0.02 | 0.001 | 15.7 | 3.8 | 2.6 | 0.01 | 0.055 | 0.037 | 0.0031 | — | — | — | 19.55 | 13.73 | Example |
| S | 0.011 | 0.24 | 0.35 | 0.02 | 0.001 | 16.1 | 3.1 | 2.8 | 0.01 | 0.053 | 0.026 | 0.0036 | 0.15 | Nb: 0.083 | — | 19.66 | 14.97 | Example |
| T | 0.041 | 0.22 | 0.41 | 0.02 | 0.001 | 16.9 | 3.7 | 2.6 | 0.01 | 0.052 | 0.044 | 0.0026 | 0.94 | Nb: 0.061 | — | 20.56 | 13.24 | Example |
| U | 0.037 | 0.25 | 0.39 | 0.02 | 0.001 | 17.9 | 7.1 | 2.0 | 0.01 | 0.049 | 0.051 | 0.0033 | 0.98 | Nb: 0.056 | — | 21.56 | 13.36 | Example |
| V | 0.025 | 0.23 | 0.52 | 0.02 | 0.001 | 17.1 | 4.2 | 3.1 | 0.01 | 0.061 | 0.039 | 0.0019 | 1.05 | Ti: 0.049 | — | 21.77 | 14.11 | Example |
| W | 0.042 | 0.25 | 0.61 | 0.02 | 0.001 | 17.7 | 4.0 | 3.2 | 0.01 | 0.053 | 0.028 | 0.0022 | 1.02 | Nb: 0.073 | — | 21.94 | 14.35 | Example |

*Left-hand side of equation (1): Cr + 0.65Ni + 0.6Mo + 0.55Cu − 20C

**Left-hand side of equation (2): Cr + Mo + 0.3Si − 43.5C − 0.4Mn − Ni − 0.3Cu − 9N

TABLE 2

| Steel pipe No. | Steel No. | Cooling after pipe making | Hot workability Presence of crack generation | Composition Types* | Amount of martensite (percent by volume) | Amount of ferrite (percent by volume) | Amount of austenite (percent by volume) | Tensile properties YS (MPa) | TS (MPa) | Corrosion resistance Corrosion rate (mm/yr) | Presence of pitting generation | Remarks |
|---|---|---|---|---|---|---|---|---|---|---|---|---|
| 1 | A | Water cooling | — | M + F + γ | 75.8 | 13.5 | 10.7 | 823 | 984 | 0.108 | No | Example |
| 2 | | Air cooling | No | M + F + γ | 73.2 | 14.6 | 12.2 | 819 | 980 | 0.114 | No | Example |
| 3 | B | Air cooling | No | M + F + γ | 55.1 | 30.3 | 14.6 | 864 | 996 | 0.093 | No | Example |
| 4 | C | Water cooling | — | M + F + γ | 56.9 | 25.2 | 17.9 | 843 | 994 | 0.097 | No | Example |
| 5 | | Air cooling | No | M + F + γ | 54.5 | 26.7 | 18.8 | 838 | 989 | 0.101 | No | Example |
| 6 | D | Air cooling | No | M + F + γ | 62.3 | 32.9 | 4.8 | 867 | 1009 | 0.105 | No | Example |
| 7 | E | Air cooling | No | M + F + γ | 65.4 | 15.2 | 19.4 | 823 | 980 | 0.098 | No | Example |
| 8 | F | Air cooling | No | M + F + γ | 58.6 | 28.4 | 13.0 | 775 | 974 | 0.094 | No | Example |
| 9 | G | Air cooling | No | M + F + γ | 57.9 | 26.1 | 16.0 | 849 | 981 | 0.076 | No | Example |
| 10 | H | Air cooling | No | M + F + γ | 66.9 | 17.4 | 15.7 | 836 | 969 | 0.104 | No | Example |
| 11 | | Air cooling | No | M + F + γ | 61.4 | 32.4 | 6.2 | 816 | 972 | 0.142 | No | Comparative example |
| 12 | J | Air cooling | No | M + F + γ | 78.2 | 10.2 | 11.6 | 763 | 989 | 0.139 | No | Comparative example |
| 13 | K | Air cooling | Yes | M + F + γ | 77.1 | 1.5 | 21.4 | 818 | 973 | 0.105 | No | Comparative example |
| 14 | L | Air cooling | Yes | M + F + γ | 76.6 | 2.9 | 20.5 | 812 | 958 | 0.132 | No | Comparative example |
| 15 | M | Air cooling | No | M + F + γ | 74.6 | 16.1 | 9.3 | 834 | 969 | 0.174 | No | Comparative example |
| 16 | N | Water cooling | — | M + F + γ | 59.6 | 33.6 | 6.8 | 829 | 984 | 0.096 | No | Example |

TABLE 2-continued

| Steel pipe No. | Steel No. | Cooling after pipe making | Hot workability Presence of crack generation | Composition Types* | Amount of martensite (percent by volume) | Amount of ferrite (percent by volume) | Amount of austenite (percent by volume) | Tensile properties YS (MPa) | Tensile properties TS (MPa) | Corrosion resistance Corrosion rate (mm/yr) | Corrosion resistance Presence of pitting generation | Remarks |
|---|---|---|---|---|---|---|---|---|---|---|---|---|
| 17 | | Air cooling | No | M + F + γ | 57.8 | 33.9 | 8.3 | 821 | 980 | 0.100 | No | Example |
| 18 | O | Water cooling | — | M + F + γ | 41.9 | 57.2 | 0 | 573 | 916 | 0.134 | Yes | Comparative example |
| 16 | P | Air cooling | No | M + F + γ | 46.2 | 50.9 | 2.9 | 691 | 892 | 0.097 | No | Example |
| 17 | Q | Air cooling | No | M + F + γ | 34.5 | 62.9 | 2.6 | 669 | 875 | 0.081 | No | Example |
| 18 | R | Air cooling | No | M + F | 83.1 | 16.9 | 0 | 964 | 1051 | 0.125 | No | Example |
| 19 | S | Water cooling | — | M + F | 72.9 | 27.1 | 0 | 1012 | 1114 | 0.119 | No | Example |
| 20 | | Air cooling | No | M + F | 71.8 | 28.2 | 0 | 1004 | 1105 | 0.122 | No | Example |
| 21 | T | Air cooling | No | M + F + γ | 62.7 | 18.8 | 18.5 | 855 | 990 | 0.097 | No | Example |
| 22 | U | Air cooling | No | M + F + γ | 64.3 | 19.5 | 16.2 | 870 | 1002 | 0.095 | No | Example |
| 23 | V | Air cooling | No | M + F + γ | 53.7 | 27.7 | 18.6 | 837 | 929 | 0.074 | No | Example |
| 24 | W | Air cooling | No | M + F + γ | 52.6 | 28.1 | 19.3 | 858 | 964 | 0.075 | No | Example |

*M: Martensite, F: Ferrite, γ: Retained austenite

According to examples, generation of cracks in the surface of the steel pipe was not observed at all, the yield strength YS was high, such as 654 MPa or more, the corrosion rate was also low, and no pitting occurred. Hence, a steel pipe was obtained having superior hot workability and corrosion resistance in a severe corrosive environment in which $CO_2$ was present and the temperature was high, such as 230° C. Furthermore, since 5% or more of a ferrite phase was contained, a steel pipe was obtained having high strength, such as a yield strength of 654 MPa or more, and superior corrosion resistance in a severe corrosive environment in which $CO_2$ was present and the temperature was high, such as 230° C.

On the other hand, according to comparative examples, cracks were generated in the surface since the hot workability was degraded or the corrosion rate was high and pitting occurred since the corrosion resistance was degraded. In particular, in the comparative example in which equation (2) was not satisfied, the hot workability was degraded, and as a result, scars were generated on the surface of the steel pipe. In addition, when the amount of ferrite was out of the preferable range, the strength was decreased, and a high strength, such as a yield strength of 654 MPa or more, could not be achieved.

Example 2

After the pipe making was performed by hot working using a steel pipe raw material having the composition (steel No. B, or No. S) shown in Table 1, air cooling was performed, so that a seamless steel pipe having an outer diameter of 83.8 mm and a wall thickness of 12.7 mm (3.3 inches and 0.5 inches in wall thickness) was obtained. From the seamless steel pipe thus obtained, a test piece raw material was obtained by cutting, followed by quenching-tempering treatment or tempering treatment shown in Table 3.

A test piece for texture observation and a test piece for measurement were formed from the test piece raw material processed by the quenching-tempering treatment in a manner similar to that in Example 1, and the fraction (percent by volume) of a ferrite phase, the fraction (percent by volume) of a retained austenite phase, and the fraction (percent by volume) of a martensite phase were obtained by calculation.

In addition, after an arc-shaped API tensile test piece was formed from the test piece raw material processed by the quenching-tempering treatment, a tensile test was performed in a manner similar to that in Example 1, so that the tensile properties (yield strength YS and tensile strength TS) were obtained. Furthermore, in a manner similar to that in Example 1, a corrosion test piece having a thickness of 3 mm, a width of 30 mm, and a length of 40 mm was formed by machining from the test piece raw material processed by the quenching-tempering treatment, and a corrosion test was then performed, so that the corrosion rate was obtained. In addition, in a manner similar to that in Example 1, the presence of pitting generated in the surface of the test piece was observed. The evaluation standard was similar to that in Example 1. The results are shown in Table 3.

TABLE 3

| Steel pipe No. | Steel No. | Cooling after pipe making | Heat treatment Quenching Heating temperature (° C.) | Quenching Cooling | Quenching Cooling stop temperature (° C.) | Tempering Heating temperature (° C.) | Composition Types* | Composition M (percent by volume) |
|---|---|---|---|---|---|---|---|---|
| 2-1 | B | Air cooling | 920 | Water cooling | 70 | 580 | M + F + γ | 55.1 |
| 2-2 | | Air cooling | 920 | Air cooling | 70 | 580 | M + F + γ | 50.7 |
| 2-3 | | Air cooling | 920 | Air cooling | 70 | 650 | M + F + γ | 45.8 |
| 2-4 | | Air cooling | 890 | Air cooling | 70 | 580 | M + F + γ | 46.7 |

TABLE 3-continued

| | | | | | | | | |
|---|---|---|---|---|---|---|---|---|
| 2-5 | | Air cooling | 860 | Air cooling | 70 | 580 | M + F + γ | 55.1 |
| 2-6 | S | Air cooling | 920 | Air cooling | 70 | 580 | M + F | 71.8 |
| 2-7 | | Air cooling | 920 | Air cooling | 70 | 650 | M + F | 69.2 |
| 2-8 | | Water cooling | — | — | — | 550 | M + F | 70.2 |
| 2-9 | | Air cooling | 890 | Air cooling | 70 | 580 | M + F | 73.2 |
| 2-10 | T | Air cooling | 920 | Air cooling | 70 | 580 | M + F + γ | 62.1 |
| 2-11 | | Air cooling | 920 | Air cooling | 70 | 580 | M + F + γ | 63.2 |
| 2-12 | | Air cooling | 920 | Air cooling | 70 | 620 | M + F + γ | 59.5 |
| 2-13 | | Air cooling | 850 | Water cooling | 70 | 580 | M + F + γ | 62.4 |
| 2-14 | | Air cooling | 850 | Air cooling | 70 | 580 | M + F + γ | 64.8 |

| | Composition | | Tensile properties | | Corrosion resistance | | |
|---|---|---|---|---|---|---|---|
| Steel pipe No. | F (percent by volume) | γ (percent by volume) | YS (MPa) | TS (MPa) | Corrosion rate (mm/yr) | Presence of pitting generation | Remarks |
| 2-1 | 30.3 | 14.6 | 864 | 996 | 0.093 | No | Example |
| 2-2 | 32.5 | 16.8 | 845 | 972 | 0.101 | No | Example |
| 2-3 | 33.0 | 21.2 | 720 | 955 | 0.103 | No | Example |
| 2-4 | 31.6 | 15.1 | 850 | 985 | 0.099 | No | Example |
| 2-5 | 30.5 | 14.4 | 860 | 991 | 0.095 | No | Example |
| 2-6 | 28.2 | 0 | 1004 | 1105 | 0.122 | No | Example |
| 2-7 | 30.8 | 0 | 984 | 1030 | 0.124 | No | Example |
| 2-8 | 29.8 | 0 | 968 | 1011 | 0.122 | No | Example |
| 2-9 | 16.8 | 0 | 1014 | 1120 | 0.118 | No | Example |
| 2-10 | 19.3 | 18.6 | 857 | 995 | 0.096 | No | Example |
| 2-11 | 18.8 | 18.0 | 849 | 991 | 0.094 | No | Example |
| 2-12 | 18.6 | 21.9 | 805 | 956 | 0.077 | No | Example |
| 2-13 | 19.2 | 18.4 | 843 | 986 | 0.096 | No | Example |
| 2-14 | 17.7 | 17.5 | 837 | 984 | 0.097 | No | Example |

*M: Martensite, F: Ferrite, γ: Retained austenite

According to the examples, the yield strength YS was high, such as 654 MPa or more, the corrosion rate was also low, and no pitting occurred. Hence, a steel pipe was obtained having superior hot workability and corrosion resistance in a severe corrosive environment in which $CO_2$ was present and the temperature was high, such as 230° C. However, in examples out of our selected range, the strength or corrosion resistance and hot workability tend to be degraded.

Example 3

After degassing was performed, molten steel having the composition shown in Table 4 was cast into an ingot in an amount of 100 kg, followed by hot working using a model seamless rolling mill for pipe making. After the pipe making, cooling (air cooling) was performed, so that a seamless steel pipe having an outer diameter of 83.8 mm and a wall thickness of 12.7 mm (3.3 inches and 0.5 inches in wall thickness) was obtained.

The seamless steel pipe thus obtained was examined by visual inspection in a manner similar to that in Example 1 whether cracks were generated in the inner and the outer surface thereof while the steel pipe was placed in a state of air cooling performed after the pipe making, so that the hot workability was evaluated. In this evaluation, the evaluation standard was similar to that in Example 1.

In addition, from the seamless steel pipe thus obtained, a test piece raw material was formed by cutting and was heated to 900° C. for 30 minutes, followed by water cooling. Furthermore, tempering treatment at 580° C. for 30 minutes was performed. After a test piece for texture observation and a test piece for measurement were obtained from the test piece raw material processed by the quenching-tempering treatment described above, the test piece for texture observation was processed by corrosion treatment using aqua regia. Subsequently, an image of the texture of the test piece was taken using a scanning electron microscope (at 1,000 magnifications), and by an image analysis device, the fraction (percent by volume) of a ferrite phase was calculated. In addition, the test piece for texture observation was obtained from the test piece raw material processed by the quenching-tempering treatment described above, and the fraction (percent by volume) of a retained austenite phase and that of a martensite phase were measured in a manner similar to that in Example 1.

In addition, after an arc-shaped API tensile test piece was obtained from the test piece raw material processed by the quenching-tempering treatment, a tensile test was performed, so that the tensile properties (yield strength YS and tensile strength TS) were obtained. In addition, after a V notch test piece (thickness: 5 mm) in accordance with JIS Z 2202 was obtained from the test piece raw material processed by the quenching-tempering treatment, a charpy impact test was performed in accordance with JIS Z 2242, so that an absorption energy $vE_{-40}$ (J) at −40° C. was obtained.

Furthermore, after a corrosion test piece having a thickness of 3 mm, a width of 30 mm, and a length of 40 mm was formed from the test piece raw material processed by the quenching-tempering treatment, a corrosion test was performed. By the way, some steel pipe was not processed by the quenching treatment but processed only by the tempering treatment.

In the corrosion test, the corrosion test piece was immersed in an aqueous test solution containing 20% of NaCl (at a solution temperature of 230° C. under 100 atmospheric pressure in a $CO_2$ gas atmosphere) placed in an autoclave and was held for 2 weeks as an immersion period. The weight of the corrosion test piece after the corrosion test was measured, and from the reduction in weight before and after the corrosion test, the corrosion rate was obtained. In addition, the resistance to pitting was evaluated by immersing the test piece in a solution containing 40% of $CaCl_2$ (liquid temperature: 70° C.) for 24 hours, so that the presence of pitting was examined. When a pitting hole having a diameter of 0.1 mm or more was formed by pitting, it was determined that pitting occurred, and in the other cases, it was determined that no pitting occurred. The results are shown in Table 5.

TABLE 4

| Steel | Chemical components (percent by mass) | | | | | | | | | | | | | | | Value of left-hand side of equation | Value of left-hand side of equation | |
|---|---|---|---|---|---|---|---|---|---|---|---|---|---|---|---|---|---|---|
| No. | C | Si | Mn | P | S | Cr | Ni | Mo | V | N | O | Cu | Other | Ca | Al | (1)* | (2)** | Remarks |
| 1A | 0.019 | 0.27 | 0.42 | 0.01 | 0.001 | 17.0 | 4.0 | 1.7 | 0.049 | 0.050 | 0.0029 | — | — | — | 0.001 | 20.24 | 13.34 | Example |
| 1B | 0.027 | 0.29 | 0.37 | 0.02 | 0.001 | 16.7 | 3.8 | 2.4 | 0.047 | 0.051 | 0.0027 | 0.94 | — | — | 0.001 | 20.59 | 13.32 | Example |
| 1C | 0.032 | 0.28 | 0.45 | 0.01 | 0.001 | 17.3 | 4.0 | 1.8 | 0.056 | 0.062 | 0.0038 | — | Nb: 0.068 | — | 0.001 | 20.34 | 13.05 | Example |
| 1D | 0.026 | 0.26 | 0.41 | 0.02 | 0.001 | 17.7 | 3.7 | 1.7 | 0.059 | 0.058 | 0.0044 | 0.79 | Ti: 0.055 | — | 0.002 | 21.04 | 13.72 | Example |
| 1E | 0.034 | 0.27 | 0.43 | 0.02 | 0.001 | 16.9 | 3.4 | 2.1 | 0.057 | 0.059 | 0.0030 | 1.05 | Zr: 0.029<br>B: 0.001 | — | 0.001 | 20.27 | 13.18 | Example |
| 1F | 0.029 | 0.26 | 0.39 | 0.02 | 0.001 | 17.5 | 3.7 | 2.6 | 0.055 | 0.052 | 0.0041 | — | — | 0.004 | 0.001 | 20.89 | 14.59 | Example |
| 1G | 0.019 | 0.22 | 0.41 | 0.01 | 0.002 | 16.8 | 3.8 | 2.0 | 0.047 | 0.042 | 0.0038 | 0.88 | Nb: 0.059 | 0.001 | 0.001 | 20.57 | 13.43 | Example |
| 1H | 0.028 | 0.29 | 0.39 | 0.02 | 0.001 | 17.7 | 4.4 | 1.7 | 0.063 | 0.048 | 0.0045 | — | W: 0.48 | — | 0.002 | 21.02 | 13.28 | Example |
| 1J | 0.035 | 0.20 | 0.42 | 0.02 | 0.002 | 16.4 | 3.3 | 2.5 | 0.051 | 0.052 | 0.0046 | — | — | — | 0.001 | 19.35 | 13.50 | Comparative example |
| 1K | 0.028 | 0.24 | 0.44 | 0.02 | 0.001 | 15.0 | 4.5 | 1.5 | 0.047 | 0.050 | 0.0038 | 1.16 | — | — | 0.002 | 18.90 | 9.88 | Comparative example |
| 1L | 0.032 | 0.25 | 0.39 | 0.02 | 0.001 | 16.6 | 3.9 | 2.1 | 0.051 | 0.055 | 0.0040 | 0.62 | Ti: 0.032 | — | 0.005 | 20.10 | 12.65 | Example |
| 1M | 0.029 | 0.24 | 0.40 | 0.02 | 0.001 | 17.5 | 2.3 | 2.3 | 0.047 | 0.053 | 0.0030 | — | — | 0.002 | 0.012 | 19.80 | 15.67 | Example |
| 1N | 0.034 | 0.22 | 0.37 | 0.02 | 0.001 | 16.2 | 4.3 | 1.6 | 0.060 | 0.051 | 0.0026 | — | Nb: 0.038 | — | 0.004 | 19.28 | 11.48 | Comparative example |
| 1P | 0.038 | 0.21 | 0.36 | 0.02 | 0.001 | 17.5 | 3.9 | 2.2 | 0.052 | 0.059 | 0.0025 | 1.04 | Nb: 0.061 | — | 0.001 | 21.17 | 13.22 | Example |
| 1Q | 0.032 | 0.26 | 0.42 | 0.02 | 0.001 | 17.2 | 4.3 | 2.6 | 0.053 | 0.068 | 0.0034 | 0.94 | — | — | 0.001 | 21.43 | 13.12 | Example |
| 1R | 0.034 | 0.21 | 0.42 | 0.02 | 0.001 | 17.6 | 4.1 | 3.0 | 0.002 | 0.055 | 0.0020 | 1.11 | — | — | 0.001 | 22.00 | 14.09 | Example |

*Left-hand side of equation (1): Cr + 0.65Ni + 0.6Mo + 0.55Cu − 20C

**Left-hand side of equation (2): Cr + Mo + 0.3Si − 43.5C − 0.4Mn − Ni − 0.3Cu − 9N

TABLE 5

| | | Quenching-tempering | | | | | | |
|---|---|---|---|---|---|---|---|---|
| | | Quenching | | | Composition (percent by volume) | | | |
| Steel pipe No. | Steel No. | Heating temperature (° C.) | Cooling | Tempering temperature (° C.) | Types* | Amount of martensite | Amount of retained γ phase | Amount of ferrite |
| 3-1 | 1A | 920 | Air cooling | 570 | M + F + γ | 56.3 | 15.2 | 28.5 |
| 3-2 | 1B | 920 | Air cooling | 570 | M + F + γ | 47.2 | 21.4 | 31.4 |
| 3-3 | 1C | 920 | Air cooling | 570 | M + F + γ | 57.5 | 15.9 | 26.6 |
| 3-4 | 1D | 920 | Air cooling | 570 | M + F + γ | 50.0 | 12.1 | 37.9 |
| 3-5 | 1E | 920 | Air cooling | 570 | M + F + γ | 57.9 | 11.8 | 30.3 |
| 3-6 | 1F | 920 | Air cooling | 570 | M + F + γ | 38.5 | 10.3 | 51.2 |
| 3-7 | 1G | 920 | Air cooling | 570 | M + F + γ | 52.5 | 13.9 | 33.6 |
| 3-8 | 1H | 920 | Air cooling | 570 | M + F + γ | 57.6 | 11.0 | 31.4 |
| 3-9 | 1J | 920 | Air cooling | 570 | M + F + γ | 54.2 | 8.5 | 37.3 |
| 3-10 | 1K | 920 | Air cooling | 570 | M + F + γ | 75.9 | 19.5 | 4.7 |
| 3-11 | 1L | 920 | Air cooling | 570 | M + F + γ | 58.7 | 18.7 | 22.6 |
| 3-12 | 1M | 920 | Air cooling | 570 | M + F | 27.7 | — | 72.3 |
| 3-13 | 1N | 920 | Air cooling | 570 | M + F + γ | 62.2 | 18.2 | 19.6 |
| 3-14 | 1P | 920 | Air cooling | 570 | M + F + γ | 66.1 | 14.4 | 19.5 |
| 3-15 | 1Q | 920 | Air cooling | 570 | M + F + γ | 65.9 | 16.5 | 17.6 |
| 3-16 | 1R | 920 | Air cooling | 570 | M + F + γ | 57.7 | 22.7 | 25.8 |

| Steel | Tensile properties | | | Hot workability | Corrosion resistance Corrosion | Pitting resistance presence | |
|---|---|---|---|---|---|---|---|
| pipe No. | YS (MPa) | TS (MPa) | Toughness $vE_{-40}$ J | Presence of crack | rate (mm/y) | of pitting generation | Remarks |
| 3-1 | 839 | 909 | 91.3 | No | 0.098 | No | Example |
| 3-2 | 826 | 968 | 83.5 | No | 0.094 | No | Example |
| 3-3 | 862 | 963 | 85.9 | No | 0.096 | No | Example |
| 3-4 | 886 | 953 | 87.3 | No | 0.079 | No | Example |

TABLE 5-continued

| | | | | | | | |
|---|---|---|---|---|---|---|---|
| 3-5 | 877 | 989 | 83.3 | No | 0.098 | No | Example |
| 3-6 | 831 | 915 | 77.5 | No | 0.091 | No | Example |
| 3-7 | 850 | 987 | 87.0 | No | 0.093 | No | Example |
| 3-8 | 899 | 919 | 81.7 | No | 0.088 | No | Example |
| 3-9 | 809 | 933 | 84.1 | No | 0.136 | No | Comparative example |
| 3-10 | 864 | 952 | 99.4 | Yes | 0.153 | No | Comparative example |
| 3-11 | 842 | 960 | 45.4 | No | 0.102 | Yes | Example |
| 3-12 | 498 | 906 | 21.6 | No | 0.117 | Yes | Example |
| 3-13 | 856 | 982 | 46.1 | No | 0.121 | Yes | Comparative example |
| 3-14 | 859 | 980 | 60.5 | No | 0.095 | No | Example |
| 3-15 | 851 | 969 | 72.7 | No | 0.091 | No | Example |
| 3-16 | 817 | 924 | 85.1 | No | 0.084 | No | Example |

*M: Martensite, F: Ferrite, γ: Retained austenite

According to the examples, generation of cracks in the surface of the steel pipe was not observed, the yield strength YS was high, such as 654 MPa or more, the corrosion rate was also low, and no pitting occurred. Hence, a steel pipe was obtained having superior hot workability and corrosion resistance in a severe corrosive environment in which $CO_2$ was present and the temperature was high, such as 230° C. Furthermore, since 5% or more of a ferrite phase was contained, a steel pipe was obtained having superior corrosion resistance in a severe corrosive environment in which $CO_2$ was present and the temperature was high, such as 230° C.; a high strength, such as a yield strength of 654 MPa or more; and a high toughness having an absorption energy of 50 J or more at−40° C. In addition, as for steel pipes Nos. 13 and 14, the content of Al was high, the toughness was slightly decreased, and pitting occurred. However, the degree thereof was not significant, and the diameter of the pitting hole by pitting was less than 0.2 mm.

On the other hand, according to the comparative examples, cracks were generated in the surface since the hot workability was degraded or the corrosion rate was high and pitting occurred since the corrosion resistance was degraded. In particular, in the comparative example in which equation (2) was not satisfied, the hot workability was degraded, and as a result, scars were generated on the surface of the steel pipe. In addition, when the amount of ferrite was out of the preferable range, the strength was decreased, and a high strength having a yield strength of 654 MPa or more could not be achieved.

INDUSTRIAL APPLICABILITY

A stainless steel pipe for use in oil wells can be stably manufactured at an inexpensive cost, the stainless steel pipe having a high strength and sufficient corrosion resistance in a severe corrosive environment in which $CO_2$ and $Cl^-$ are present and the temperature is high, or further having a high toughness. Hence, significant industrial advantages can be obtained. In addition, another advantage can also be obtained in that a sufficient strength as an oil-well pipe can be obtained only by performing heat treatment after pipe making.

The invention claimed is:

1. A high strength stainless steel seamless pipe for use in oil wells, which has superior corrosion resistance, comprising on a mass percent basis:

0.005% to 0.05% of C;
0.05% to 0.5% of Si;
0.2% to 1.8% of Mn;
0.03% or less of P;
0.005% or less of S;
15.5% to 18% of Cr;
1.5% to 5% of Ni;
1% to 3.5% of Mo;
0.02% to 0.2% of V;
0.01% to 0.15% of N;
0.006% or less of 0; and
the balance being Fe and unavoidable impurities,
wherein the following equations (1) and (2) are satisfied $$Cr+0.65Ni+0.6Mo+0.55Cu-20C \geqq 19.5 \quad (1)$$

$$Cr+Mo+0.3Si-43.5C-0.4Mn—Ni-0.3Cu-9N \geqq 11.5 \quad (2)$$

wherein Cr, Ni, Mo, Cu, C, Si, Mn, and N represent the respective contents on a mass percent basis, and contains an austenite phase at a volume fraction between 2.6% and 30%, a ferrite phase at a volume fraction between 10% and 60% and a martensite phase as the balance of the volume fraction, and has a yield strength of 654 MPa or more.

2. The high strength stainless steel seamless pipe for use in oil wells, according to claim 1, further comprising 0.002% to 0.05% of Al on a mass percent basis.

3. The high strength stainless steel seamless pipe for use in oil wells, according to claim 1, wherein the content of C is in the range of 0.03% to 0.05% on a mass percent basis.

4. The high strength stainless steel seamless pipe for use in oil wells, according to claim 1, wherein the content of Cr is in the range of 16.6% to less than 18% on a mass percent basis.

5. The high strength stainless steel seamless pipe for use in oil wells, according to claim 1, wherein the content of Mo is in the range of 2% to 3.5% on a mass percent basis.

6. The high strength stainless steel seamless pipe for use in oil wells, according to claim 1, further comprising 0.5% to 3.5% of Cu on a mass percent basis.

7. The high strength stainless steel seamless pipe for use in oil wells, according to claim 6, wherein the content of Cu is in the range of 0.5% to 1.14% on a mass percent basis.

8. The high strength stainless steel seamless pipe for use in oil wells, according to claim 1, further comprising at least one selected from 0.03% to 0.2% of Nb, 0.03% to 0.3% of Ti, 0.03% to 0.2% of Zr, 0.2% to 3% of W, and 0.0005% to 0.01% of B on a mass percent basis.

9. The high strength stainless steel seamless pipe for use in oil wells, according to claim 1, further comprising 0.0005% to 0.01% of Ca on a mass percent basis.

10. The high strength stainless steel seamless pipe for use in oil wells, according to claim 1, wherein the stainless steel seamless pipe has a texture containing a martensite phase as a primary phase.

11. The high strength stainless steel seamless pipe for use in oil wells, according to claim 10, wherein the ferrite phase has a volume fraction of 15% to 50%.

12. The high strength stainless steel seamless pipe according to claim 1, wherein the ferrite phase is present at a volume fraction between 15% and 60%.

13. The high strength stainless steel seamless pipe according to claim 1, wherein the volume fraction of the martensite phase is at most 75.8%.

* * * * *